US010123617B2

(12) United States Patent
Rollins et al.

(10) Patent No.: US 10,123,617 B2
(45) Date of Patent: Nov. 13, 2018

(54) SHELF FOR STORAGE RACKS

(71) Applicant: Nashville Wire Products Manufacturing Company, LLC, Nashville, TN (US)

(72) Inventors: Phillip Kent Rollins, Nashville, TN (US); Randall Louis Berg, Murfreesboro, TN (US)

(73) Assignee: Nashville Wire Products Manufacturing Company, LLC, Nashville, TN (US)

( * ) Notice: Subject to any disclaimer, the term of this patent is extended or adjusted under 35 U.S.C. 154(b) by 0 days.

(21) Appl. No.: 15/237,335

(22) Filed: Aug. 15, 2016

(65) Prior Publication Data

US 2017/0042329 A1 Feb. 16, 2017

Related U.S. Application Data

(60) Provisional application No. 62/205,485, filed on Aug. 14, 2015.

(51) Int. Cl.
*A47B 96/02* (2006.01)

(52) U.S. Cl.
CPC ..... *A47B 96/021* (2013.01)

(58) Field of Classification Search
CPC ..... A47B 96/00; A47B 96/02; A47B 96/021; A47B 96/024; A47B 47/021; A47B 47/0083
See application file for complete search history.

(56) References Cited

U.S. PATENT DOCUMENTS 1,409,092 A * 3/1922 Goldfield ..... B65D 19/0075 108/57.23
2,121,269 A * 6/1938 Sisson ..... B61D 27/0027 105/375
2,381,608 A * 8/1945 Leyerle ..... F26B 25/18 211/153
2,570,326 A * 10/1951 De Angelis ..... E04D 3/365 108/57.3
3,093,216 A * 6/1963 Dunham ..... E04C 2/08 105/375
3,196,812 A * 7/1965 Jacques ..... A47B 96/021 108/108

(Continued)

FOREIGN PATENT DOCUMENTS

EP 0761134 A1 * 3/1997 ..... A47B 96/02
WO WO 2008029019 A1 * 3/2008 ..... A47B 96/021

*Primary Examiner* — Kimberley S Wright
(74) *Attorney, Agent, or Firm* — Lucian Wayne Beavers; Patterson Intellectual Property Law, PC

(57) ABSTRACT

An apparatus that can be used to hold varying weights contains a planar body, a plurality of support beams, a first beam receiving channel, and a second beam receiving channel. When in use, items are stored upon a load bearing surface of the planar body. The plurality of support beams is slidably positioned in between the first beam receiving channel and the second beam receiving channel. Depending on the weight of the items, the user can adjust the number of the plurality of support beams being utilized. When the items are stored, the weight of the items are evenly distributed among the plurality of support beams. Since the plurality of support beams is positioned opposite to the load bearing surface, the items can be stored with no interference.

6 Claims, 9 Drawing Sheets

(56) References Cited

U.S. PATENT DOCUMENTS 3,323,656 A * 6/1967 Weiss ..... A47B 96/021 108/152
3,556,306 A * 1/1971 Shell ..... A47B 96/027 108/108
3,643,607 A * 2/1972 MacKenzie ..... A47B 96/025 108/180
3,814,034 A * 6/1974 Seiz ..... A62C 35/58 108/187
3,986,616 A * 10/1976 Gray ..... A47B 57/18 108/107
4,078,664 A * 3/1978 McConnell ..... A47B 96/00 108/159
4,519,508 A * 5/1985 Gullett ..... A47B 57/04 108/107
4,535,898 A * 8/1985 Jones ..... A47B 96/021 211/153
4,832,209 A * 5/1989 Schafer ..... A47B 96/021 211/135
5,011,031 A * 4/1991 Konstant ..... A47B 47/027 211/191
5,383,409 A * 1/1995 Hayakawa ..... B65D 19/0016 108/51.3
5,577,623 A * 11/1996 Bustos ..... A47B 57/00 108/180
5,816,173 A * 10/1998 Warneford ..... B65D 19/0012 108/51.11
6,039,192 A * 3/2000 Hollander ..... A47B 96/021 211/186
6,050,428 A * 4/2000 Hollander ..... B65G 1/02 211/135
6,173,658 B1 * 1/2001 Moberg ..... B65D 19/0016 108/51.3
6,401,944 B1 * 6/2002 Kircher ..... A47B 96/021 108/157.13
6,997,112 B2 * 2/2006 Nishizaki ..... B65D 19/0012 108/51.3
7,156,243 B2 * 1/2007 Henning ..... A47B 96/021 211/153
7,357,262 B2 * 4/2008 Fratilla ..... A47B 47/02 211/117
7,810,438 B2 * 10/2010 Ryberg ..... A47B 96/024 108/42
7,913,629 B2 * 3/2011 Gordon ..... B65D 19/0016 108/51.3
7,918,516 B2 * 4/2011 Decker ..... A47B 96/021 108/108
8,302,788 B2 * 11/2012 Vargo ..... A47B 47/021 211/186
8,443,992 B2 * 5/2013 Lawson ..... A47B 47/028 211/187
8,899,162 B2 * 12/2014 Chikkakalbalu ..... A47B 96/027 108/108
9,027,767 B2 * 5/2015 Buckley ..... A47F 5/00 211/134
9,215,926 B1 * 12/2015 Offerman ..... A47B 47/02
9,375,102 B2 * 6/2016 Troyner ..... A47B 47/021
9,376,809 B1 * 6/2016 Trover ..... E04B 5/02
9,386,855 B2 * 7/2016 Sabounjian ..... A47B 96/14
2007/0034583 A1 * 2/2007 Henning ..... A47B 96/021 211/153
2008/0169256 A1 * 7/2008 Shetler ..... A47B 96/021 211/153
2010/0077781 A1 * 4/2010 Decker ..... A47B 96/021 62/251
2012/0000871 A1 * 1/2012 Troyner ..... A47B 47/021 211/134
2012/0067838 A1 * 3/2012 Lawson ..... A47B 47/024 211/134
2014/0116973 A1 * 5/2014 Buckley ..... A47F 5/00 211/134
2015/0090683 A1 * 4/2015 Sabounjian ..... A47B 96/14 211/186
2016/0220018 A1 * 8/2016 Hanlon ..... A47B 47/0083

* cited by examiner

SHELF FOR STORAGE RACKS

The current application claims a priority to the U.S. Provisional Patent application Ser. No. 62/205,485 filed on Aug. 14, 2015. The current application is filed on Aug. 15, 2016 while Aug. 14, 2016 was on a weekend.

FIELD OF THE INVENTION

The present invention relates generally to shelves for storage racks. More specifically, the present invention is a new and improved shelf that requires less materials to manufacture, and can be customized for varying weights. Therefore, the present invention is financially advantageous and also convenient since assembling the present invention takes minimal effort.

BACKGROUND OF THE INVENTION

Storage methods have changed over time in order to fulfil different storage needs. Among the many methods of storing, storage shelves are one of the most effective methods of storing items. Floor space savings and the ease of access to stored items are some of the main reasons that make storage shelves one of the most effective storage methods.

However, storage shelves can have certain disadvantages too. The weight restrictions and difficulty in assembling are among the most significant disadvantages with existing shelves. The weight restrictions occur mainly due to the material the shelf is built from and the design of the shelf. As an example, a shelf manufactured from wood can hold more weight than a shelf that is manufactured from plastic. The use of metal shelves solves the limitation caused by weight. However, the use of metal can be financially disadvantageous. Moreover, assembling metal shelves can be a time consuming process. Therefore, the need for a shelf that can be conveniently assembled and would also have minimum manufactural costs is clearly evident.

Safety is another concern related to plastic shelves. In other words, the tendency for a free standing plastic shelf to lose stability is comparatively higher. The unstable nature of these shelves can damage not only the items stored on the shelf but can also injure a user in close proximity to the shelf.

The objective of the present invention is to address the aforementioned issues. In particular, the present invention introduces a shelfing method which is convenient to assemble, financially advantageous, and can also hold varying weights with no additional modifications to the overall design of the product. When comparing to traditional shelves, the present invention requires minimal amount of material which is financially advantageous in the manufacturing process. In other words, the present invention provides a superior product using less materials, and provides a convenient way to increase the load bearing strength for the shelf on an as needed basis through the addition of detachable support members.

DETAIL DESCRIPTIONS OF THE INVENTION

All illustrations of the drawings are for the purpose of describing selected versions of the present invention and are not intended to limit the scope of the present invention.

The present invention introduces a new and improved shelf that can be used in storage racks and other comparable storage methods. The effective design allows the user to conveniently assemble the present invention and stack more items compared to traditional storage shelves. The supporting beams used in the present invention allows the user to add more items onto the shelf with no safety concerns.

Figure 1:
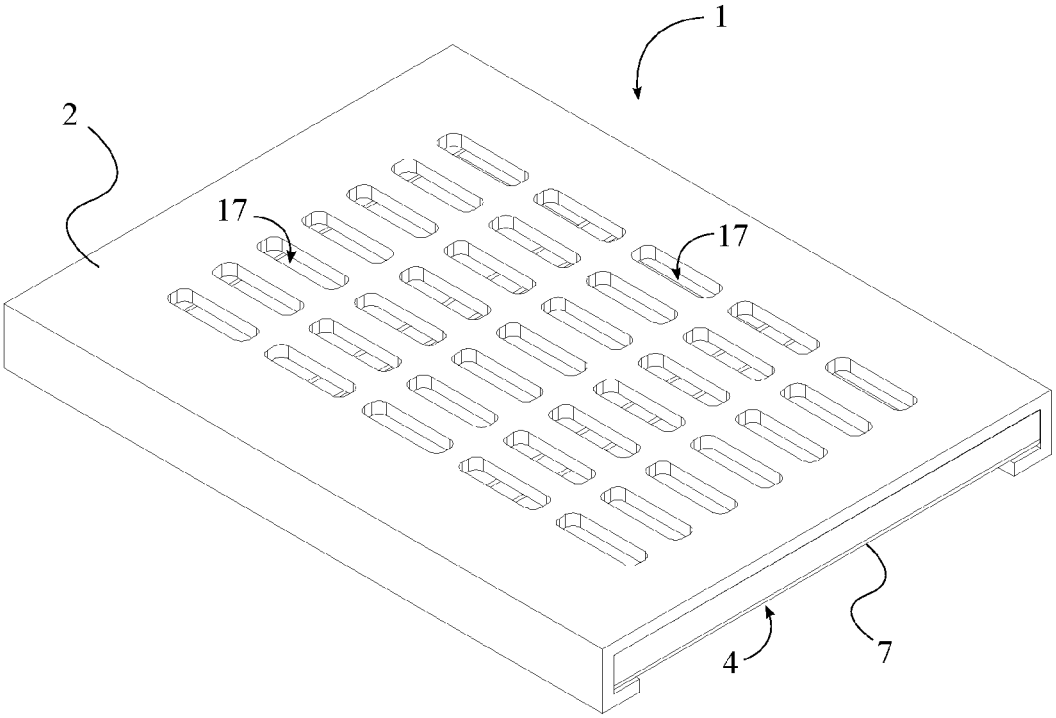
FIG. 1 is a perspective view of the present invention.
Figure 2:
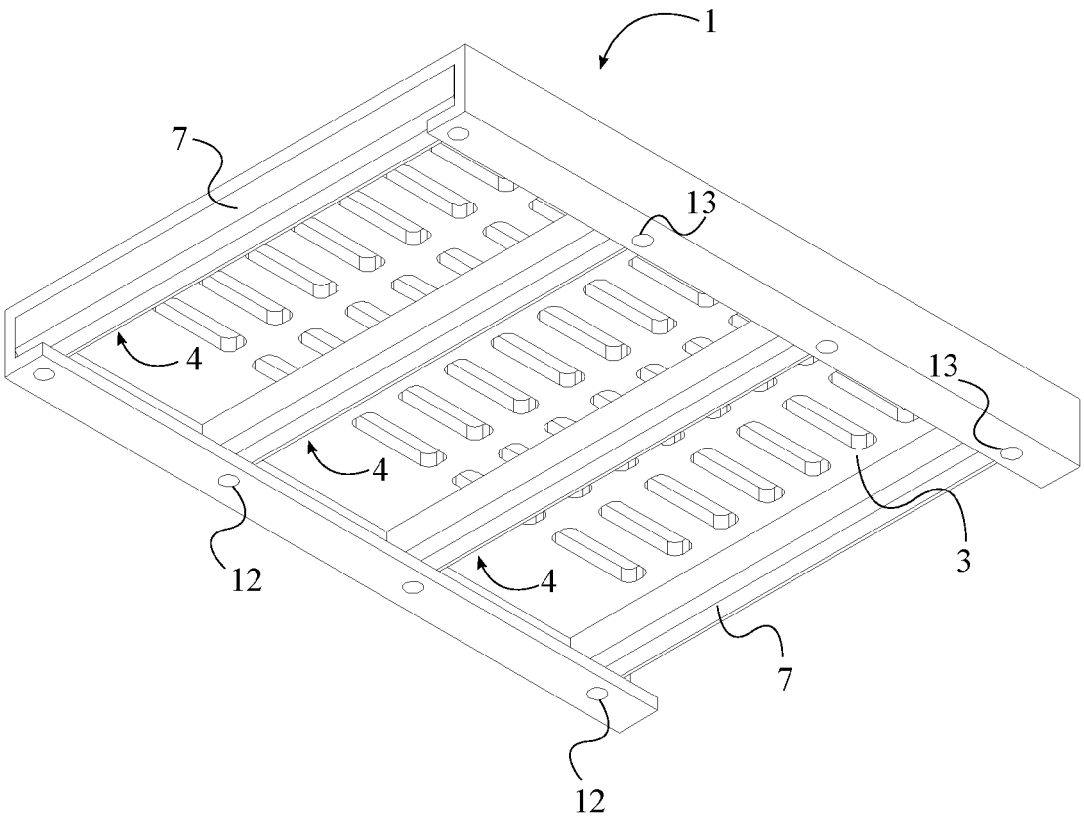
FIG. 2 is a bottom perspective view of the present invention.
Figure 3:
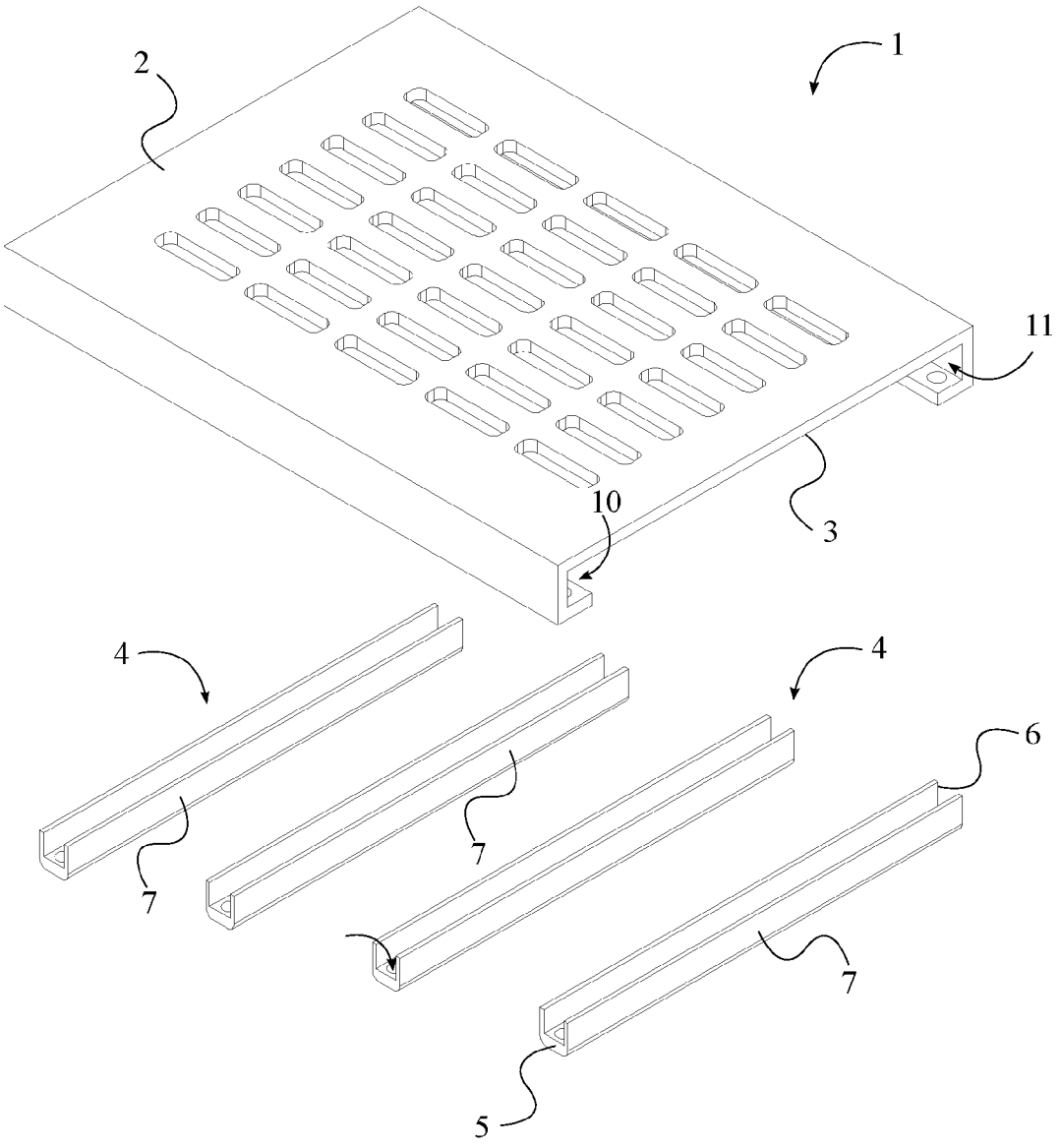
FIG. 3 is an exploded view of the present invention, wherein the planar body and the plurality of support beams is illustrated.
Figure 4:
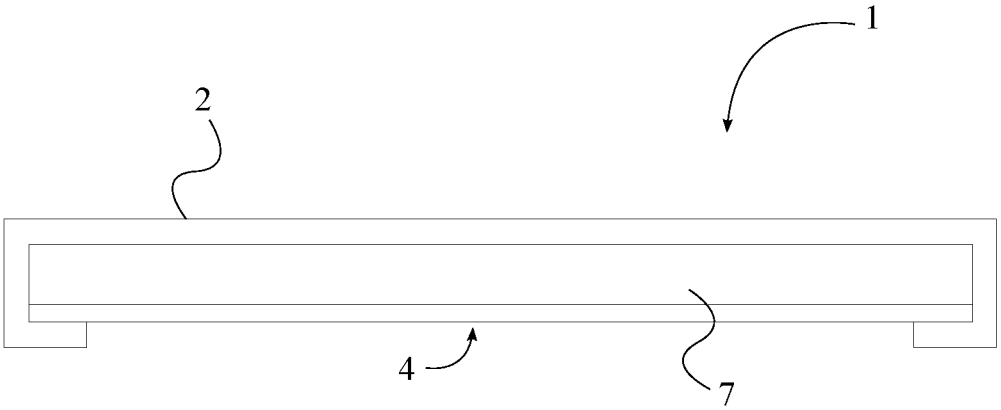
FIG. 4 is a side view of the present invention, wherein the assembly of the planar body and the plurality of support beams is represented.
Figure 5:
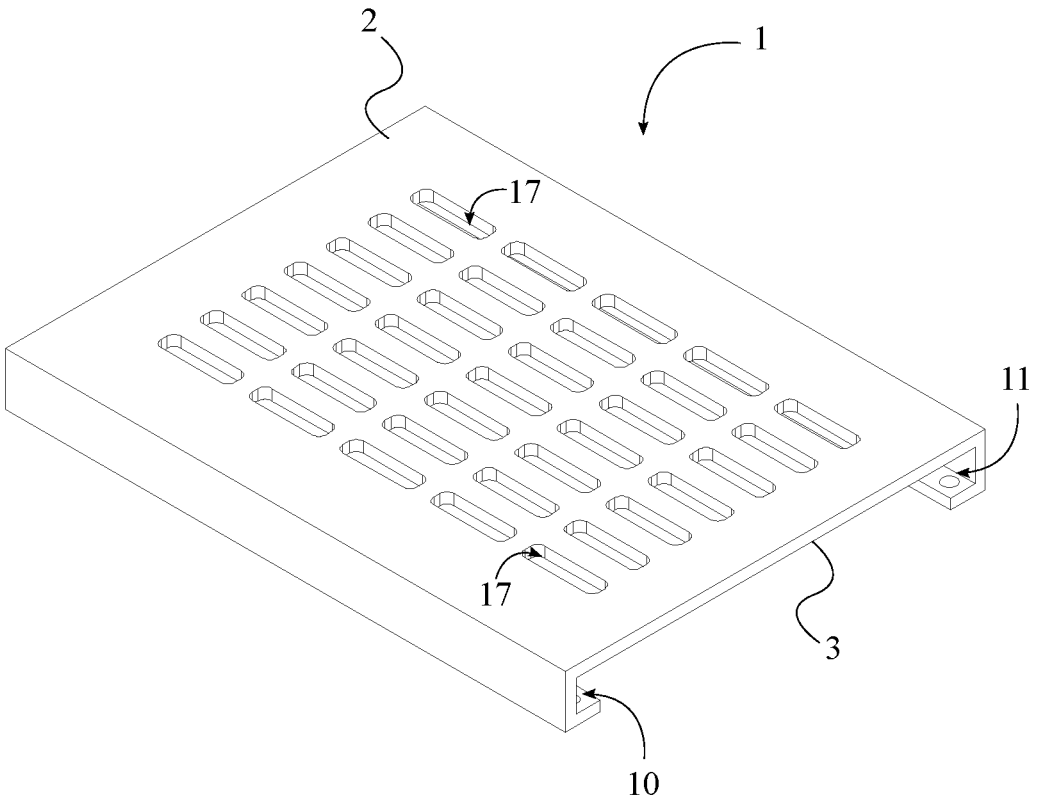
FIG. 5 is a perspective view of the planar body of the present invention.
Figure 6:
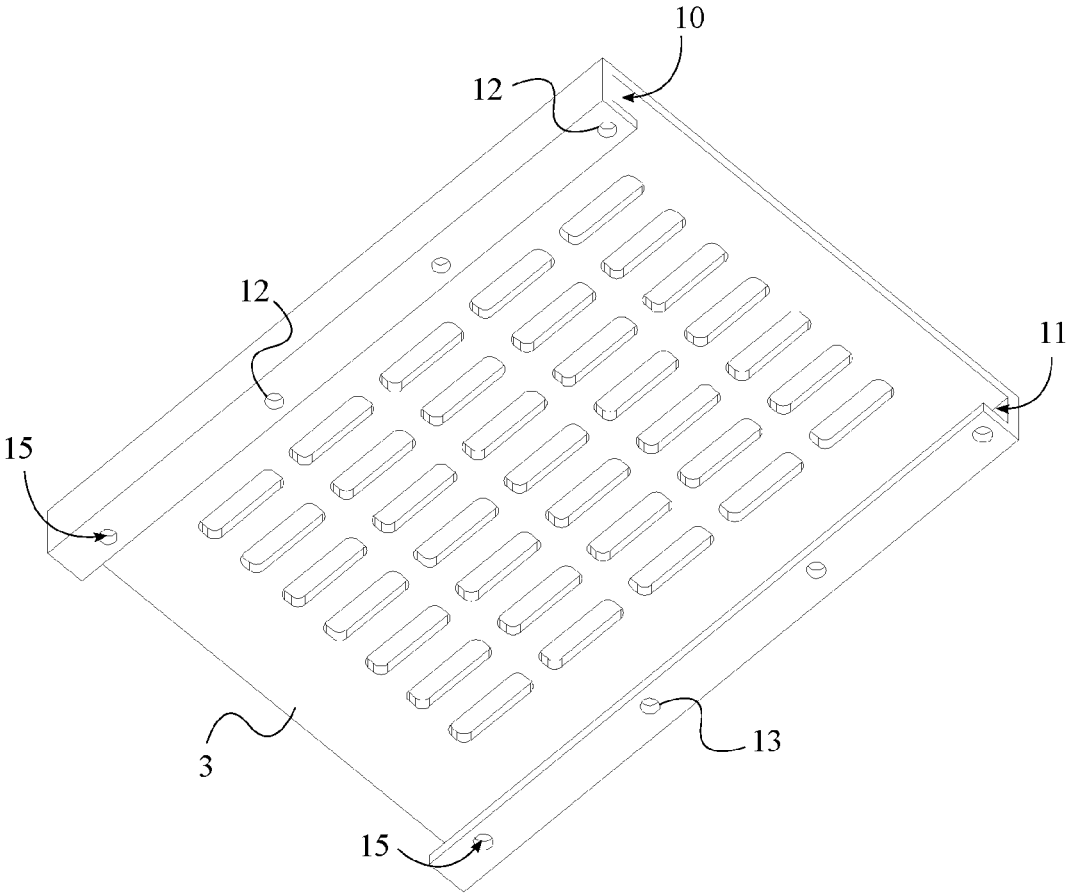
FIG. 6 is a bottom perspective view of the planar body of the present invention.

As illustrated in FIGS. 1-3, FIG. 5, and FIG. 6 the present invention comprises a planar body 1, a plurality of support beams 4, a first beam receiving channel 10, and a second beam receiving channel 11. The planar body 1 in the preferred embodiment of the present invention is rectangular in shape. However, the shape of the planar body 1 can vary in different embodiments of the present invention. The planar body 1 comprises a load bearing surface 2 and a bottom surface 3, wherein the bottom surface 3 is positioned opposite to the load bearing surface 2. The plurality of support beams 4 is used to provide support to the planar body 1 which bears the weight of the items stacked on the load bearing surface 2. In order to position the plurality of support beams 4, the first beam receiving channel 10 and the second beam receiving channel 11 are positioned adjacent to the bottom surface 3. The shape of the first beam receiving channel 10 and the second beam receiving channel 11 can vary in different embodiments of the present invention. In the preferred embodiment of the present invention, the first beam receiving channel 10 and the second beam receiving channel 11 is U-shaped. However, in another embodiment of the present invention the first beam receiving channel 10 and the second beam receiving channel 11 can be, but is not limited to being J-shaped. The first beam receiving channel 10 and the second beam receiving channel 11 is positioned such that the plurality of support beams 4 does not interfere with the items stored on the load bearing surface 2. Moreover, the first beam receiving channel 10 and the second beam receiving channel 11 are positioned opposite to each other and across the bottom surface 3 and extends along the planar body 1. The positioning of the first beam receiving channel 10 and the second beam receiving channel 11 help the weight of the items stored to be evenly distributed among the plurality of support beams 4. In order to do so, the plurality of support beams 4 is oriented perpendicular to the first beam receiving channel 10 and the second beam receiving channel 11. Moreover, the plurality of support beams 4 is slidably positioned in between the first beam receiving channel 10 and the second beam receiving channel 11. The slidable positioning allows the user to conveniently position each of the plurality of support beams 4 as required according to the weight of the items stored. The first beam receiving channel 10 and the second beam receiving channel 11 are appropriately sized to allow the plurality of support beams 4 to be repositioned conveniently as shown in FIG. 4.

Figure 7:
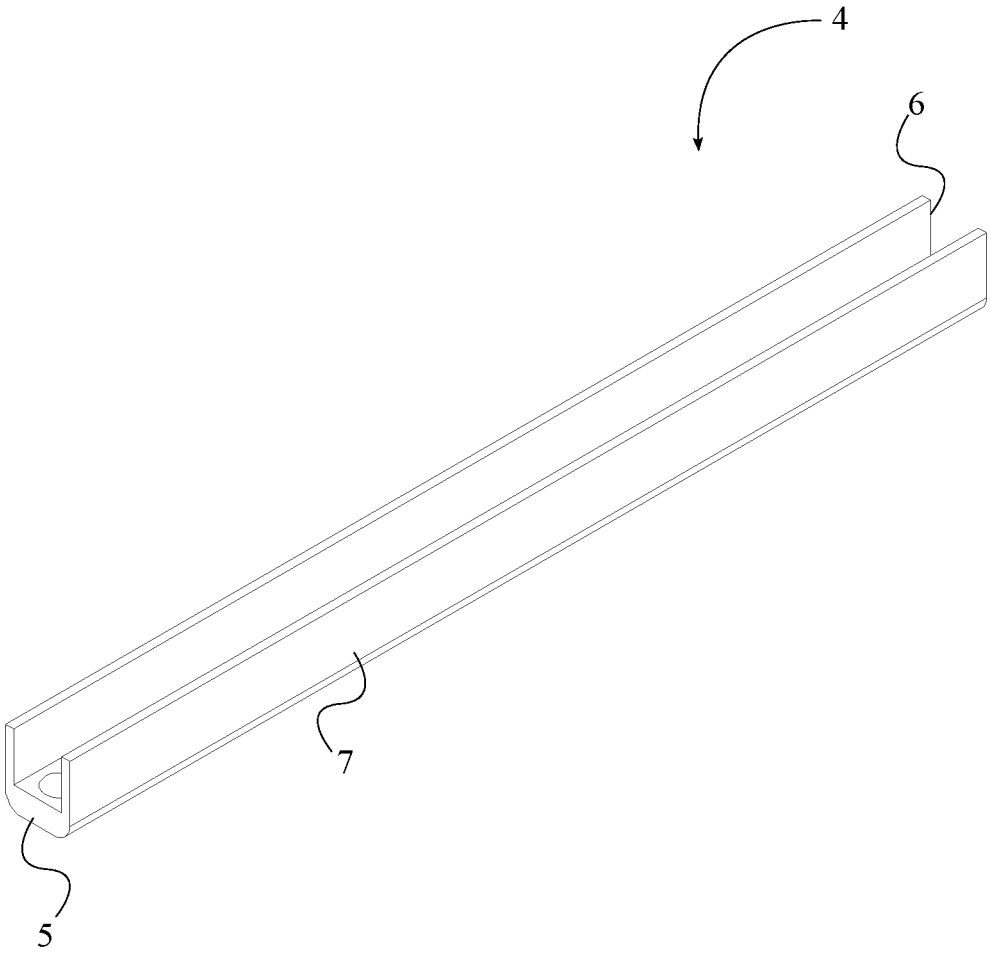
FIG. 7 is a perspective view of one of the plurality of support beams of the present invention.
Figure 8:
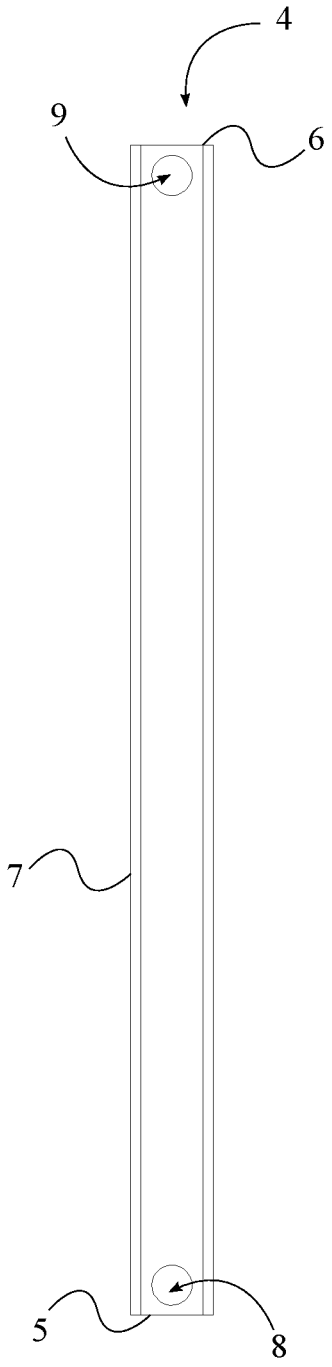
FIG. 8 is a top view of one of the plurality of support beams of the present invention.

The shape and size of the plurality of support beams 4 can vary in different embodiments of the present invention. However, the plurality of support beams 4 should be appropriately sized to fit within the first beam receiving channel 10 and the second beam receiving channel 11. In the preferred embodiment of the present invention, each of the plurality of support beams 4 has an overall U-shape. As illustrated in FIG. 7 and FIG. 8, each of the plurality of support beams 4 comprises a first end 5, a second end 6, and a body 7, wherein the body 7 extends from the first end 5 to the second end 6. As mentioned before when the plurality of support beams 4 is positioned in between the first beam receiving channel 10 and the second beam receiving channel 11, the first end 5 is slidably positioned within the first beam receiving channel 10. On the other hand, the second end 6 is being slidably positioned within the second beam receiving channel 11. The length of the body 7 is such that the plurality of support beams 4 snugly fit in between the first beam receiving channel 10 and the second beam receiving channel 11.

For a sturdy structure, the plurality of support beams 4 need to be secured in between the first beam receiving channel 10 and the second beam receiving channel 11. In order to do so, each of the plurality of support beams 4 further comprises a first bolt opening 8 and a second bolt opening 9. The first bolt opening 8 is positioned at the first end 5 and traverses through the body 7. Similarly, the second bolt opening 9 is positioned at the second end 6 and traverses through the body 7. The first bolt opening 8 and the second bolt opening 9 are used to attach each of the plurality of support beams 4 to the first beam receiving channel 10 and the second beam receiving channel 11.

Figure 9:
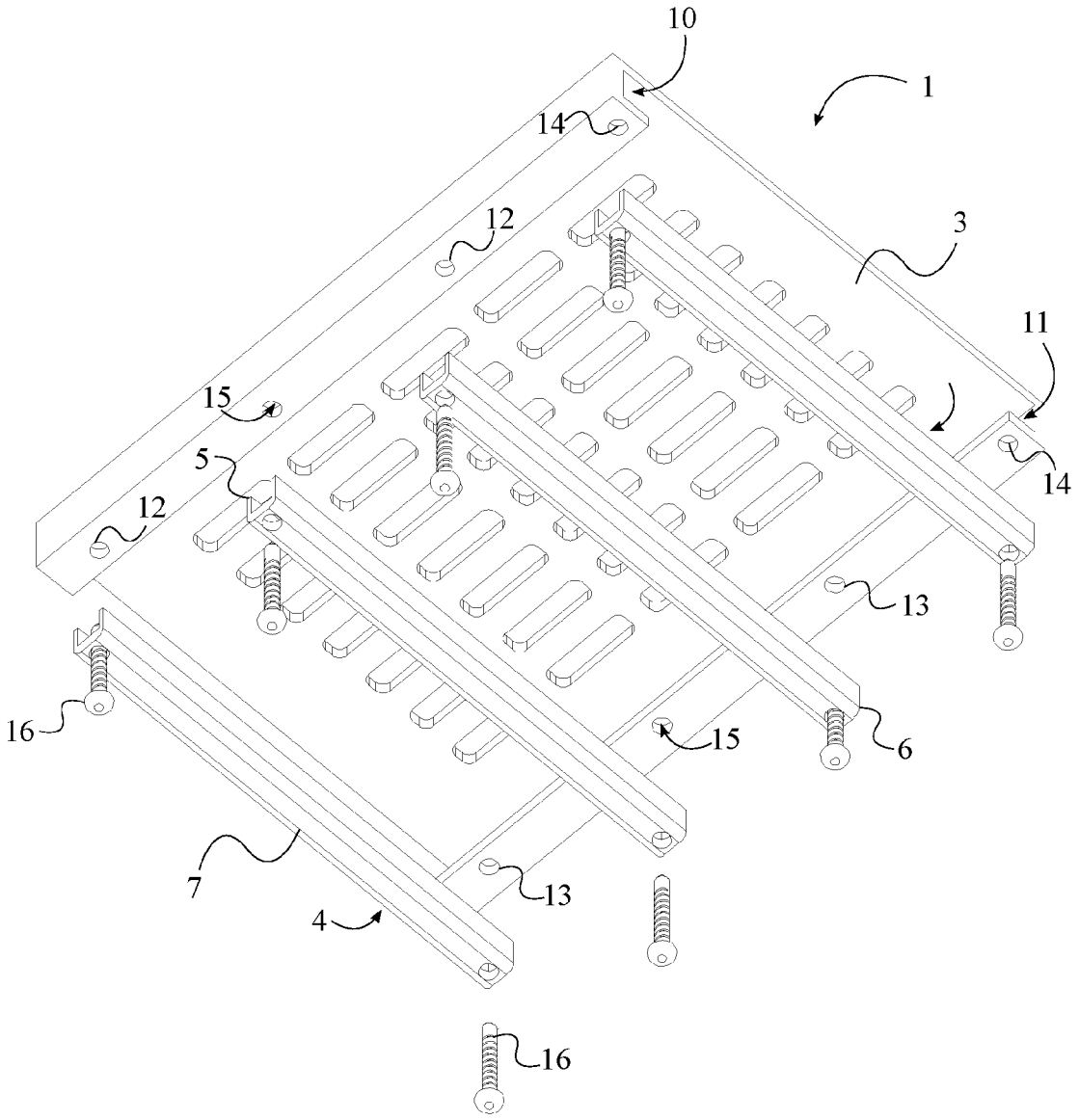
FIG. 9 is an exploded view of the present invention, wherein the planar body is attached to the plurality of support beams.

The present invention further comprises a first plurality of fastening points 12 and a second plurality of fastening points 13. Both the first plurality of fastening points 12 and the second plurality of fastening points 13 are used to secure the plurality of support beams 4. As mentioned before, the weight of the items stored on the load bearing surface 2 needs to be evenly distributed among the plurality of support beams 4. In order to do so, the plurality of support beams 4 need to be positioned equidistantly. To position the plurality of support beams 4 equidistantly, the first plurality of fastening points 12 and the second plurality of fastening points 13 also need to be positioned appropriately. In doing so, the first plurality of fastening points 12 is evenly distributed along the first beam receiving channel 10. Similarly, the second plurality of fastening points 13 is also evenly distributed along the second beam receiving channel 11. The positioning is such that, each of the first plurality of fastening points 12 and a corresponding point from the second plurality of fastening points 13 are aligned as a pair of beam anchoring points 14. When positioning the plurality of support beams 4, each of the plurality of support beams 4 is mounted between the pair of beam anchoring points 14. In the preferred embodiment of the present invention, the pair of beam anchoring points 14 is a pair of bolt receiving holes 15. As shown in FIG. 9, each of the plurality of support beams 4 is positioned such that the first bolt opening 8 and the second bolt opening 9 is concentrically aligned with each of the pair of bolt receiving holes 15.

In order to be used with the pair of bolt receiving holes 15 the present invention comprises a pair of bolts 16 for each of the plurality of support beams 4. When the pair of bolts 16 is in use, each of the plurality of support beams 4 is mounted between the pair of beam anchoring points 14 by the pair of bolts 16. Since the pair of bolts 16 is inserted to the bolt receiving holes 15 opposite to the load bearing surface 2, the pair of bolts 16 or other comparable fastener does not interfere with the items stored on the load bearing surface 2.

The present invention further comprises a plurality of perforations 17 that is distributed across the planar body 1 and traverses through the planar body 1. The shape and size of the plurality of perforations 17 can vary in different embodiments of the present invention. The plurality of perforations 17 has many benefits to the present invention. As an example, the overall material volume needed to produce the present invention is reduced. Moreover, the plurality of perforations 17 is also beneficial when removing a liquid from the load bearing surface 2.

When utilizing the present invention, the following process flow is generally followed. Initially, the plurality of support beams 4 is positioned in between the first beam receiving channel 10 and the second beam receiving channel 11. More specifically, the first end 5 is slidably positioned within the first beam receiving channel 10. Simultaneously, the second end 6 is slidably positioned within the second beam receiving channel 11. Upon positioning the plurality of support beams 4, the first bolt opening 8 and the second bolt opening 9 of each of the plurality of support beams 4 is aligned with the first plurality of fastening points 12 and the second plurality of fastening points 13. Next, the plurality of support beams 4 is fastened to the first beam receiving channel 10 at the first plurality of fastening points 12. Similarly, the plurality of support beams 4 is also fastened to the second beam receiving channel 11 at the second plurality of fastening points 13. If a considerably large weight is applied at the load bearing surface 2, each of the first plurality of fastening points 12 and each of the second plurality of fastening points 13 can be used. However, if a considerably small weight is applied at the load bearing surface 2 a portion of the first plurality of fastening points 12 and a portion of the second plurality of fastening points 13 can be used. When the plurality of support beams 4 is successfully fastened to the planar body 1, the assembly can be used on the appropriated storage rack.

Although the invention has been explained in relation to its preferred embodiment, it is to be understood that many other possible modifications and variations can be made without departing from the spirit and scope of the invention as hereinafter claimed.

What is claimed is:

1. A metal shelf for a storage rack comprising:

a metal planar body;

a plurality of metal support beams;

a first beam receiving channel;

a second beam receiving channel;

the planar body comprising a load bearing surface and a bottom surface, the planar body having first and second edges positioned opposite to each other;

the first beam receiving channel and the second beam receiving channel being positioned adjacent to the bottom surface;

the first and second beam receiving channels being integrally formed with the planar body, the first beam receiving channel being defined by a first metal sidewall extending downward from the planar body and by a first metal lower lip extending from the first metal sidewall back under the planar body, and the second beam receiving channel being defined by a second metal sidewall extending downward from the planar body and by a second metal lower lip extending from the second metal sidewall back under the planar body, the first and second metal sidewalls being solid non-perforated metal sidewalls;

the first beam receiving channel and the second beam receiving channel being positioned opposite to each other across the bottom surface;

the first beam receiving channel and the second beam receiving channel extending along the planar body all the way from the first edge to the second edge of the planar body;

the plurality of support beams being oriented perpendicular to the first beam receiving channel and the second beam receiving channel;

the plurality of support beams being positioned in between the first beam receiving channel and the second beam receiving channel; and at least one of the support beams being located adjacent and aligned with one of the first and second edges of the planar body so as to define an edge of the shelf each of the plurality of support beams including a first end, a second end, and a body;

the body extending from the first end to the second end;

the first end being positioned within the first beam receiving channel; and the second end being positioned within the second beam receiving channel;

each of the plurality of support beams further including a first fastener opening and a second fastener opening;

the first fastener opening being positioned within the first beam receiving channel; and the second fastener opening being positioned within the second beam receiving channel;

a first plurality of fastening points;

a second plurality of fastening points;

the first plurality of fastening points being evenly distributed along the first beam receiving channel;

the second plurality of fastening points being evenly distributed along the second beam receiving channel;

each of the first plurality of fastening points and a corresponding point from the second plurality of fastening points being aligned as a pair of beam anchoring points; and each of the plurality of support beams being mounted between one of the pairs of beam anchoring points;

wherein each pair of beam anchoring points is a pair of fastener receiving holes.

2. The metal shelf for a storage rack as claimed in claim 1 further comprising:

a pair of fasteners for each of the plurality of support beams; and each of the plurality of support beams being mounted between one of the pairs of beam anchoring points by the pair of fasteners.

3. The metal shelf for a storage rack as claimed in claim 1 further comprising:

a plurality of perforations;

the plurality of perforations being distributed across the planar body; and the plurality of perforations traversing through the planar body.

4. The metal shelf for a storage rack as claimed in claim 1, wherein the first beam receiving channel and the second beam receiving channel are each U-shaped.

5. The metal shelf for a storage rack as claimed in claim 1, wherein the first beam receiving channel and the second beam receiving channel are each J-shaped.

6. The metal shelf for a storage rack as claimed in claim 1, wherein:

the plurality of support beams includes at least three support beams, and at least one of the support beams is an intermediate support beam located between two others of the support beams.

* * * * *